United States Patent [19]

Shinoda et al.

[11] Patent Number: 4,476,831

[45] Date of Patent: Oct. 16, 1984

[54] METHOD AND APPARATUS FOR CONTROLLING THE FUEL SUPPLY OF AN INTERNAL COMBUSTION ENGINE

[75] Inventors: Kazuo Shinoda, Toyota; Toshiaki Isobe, Nagoya, both of Japan

[73] Assignee: Toyota Jidosha Kabushiki Kaisha, Toyota, Japan

[21] Appl. No.: 477,852

[22] Filed: Mar. 22, 1983

[30] Foreign Application Priority Data

Mar. 24, 1982 [JP] Japan ..... 57-045547

[51] Int. Cl.[3] ..... F02D 5/00

[52] U.S. Cl. ..... 123/480; 123/486

[58] Field of Search ..... 123/480, 486, 478, 488; 364/431.05

[56] References Cited

U.S. PATENT DOCUMENTS 3,969,614 7/1976 Moyer et al. ..... 123/480

*Primary Examiner*—Andrew M. Dolinar

*Attorney, Agent, or Firm*—Cushman, Darby & Cushman

[57] ABSTRACT

Fuel supply to an internal combustion engine is controlled in accordance with a fuel injection signal which depends on intake manifold pneumatic pressure and on engine running speed. A basic pulse width of the fuel injection signal is calculated by (1) multiplying a one-dimensional function of the detected intake manifold pneumatic pressure by a first weighting factor, (2) multiplying a two-dimensional function of the detected intake manifold pneumatic pressure and of the detected engine running speed, and (3) totalling the multiplied functions.

14 Claims, 5 Drawing Figures

METHOD AND APPARATUS FOR CONTROLLING THE FUEL SUPPLY OF AN INTERNAL COMBUSTION ENGINE

BACKGROUND OF THE INVENTION

1. Field of the Invention

The present invention relates to a fuel supply control method and apparatus for an internal combustion engine.

2. Description of the Prior Art

In one known fuel supply control method, the engine running speed and the intake manifold pneumatic pressure are detected and then used to calculate the basic pulse width of an injection signal to be applied to the fuel injectors. This basic pulse width is corrected in accordance with other engine operating parameters such as the exhaust-gas oxygen concentration, coolant temperature, atmospheric temperature, and degree of acceleration. The corrected pulse-width is used to adjust the actual fuel feed.

In general, a two-dimensional function table indicative of the relationship between the basic pulse width and the intake manifold pneumatic pressure and engine running speed is provided in a storage device beforehand. A basic pulse width corresponding to the detected engine parameters is found from this function table by interpolation.

Since the maximum value of the basic pulse width is about 7 msec, each item of the function table must be composed of two or more bytes (assuming a byte of 8 bits) in order to obtain accurate data on the basic pulse width. Composing each item of the two-dimensional function table by two or more bytes, however, leads to an extreme increase in the cost of the storage device.

SUMMARY OF THE INVENTION

It is therefore an object of the present invention to provide a method and apparatus for controlling the fuel supply of an internal combustion engine whereby the number of bits for a function table in a storage device with respect to the basic pulse width of an injection signal can be reduced without lowering the accuracy of the calculated basic pulse width.

The above object is achieved by a fuel supply control method comprising the steps of: detecting the intake manifold pneumatic pressure to produce a first electrical signal; detecting the engine running speed to produce a second electrical signal; calculating, in response to the first electrical signal, a first fuel supply amount, the calculation being performed by multiplying a one-dimensional function of the detected intake manifold pneumatic pressure by a first weighting factor; calculating, in response to the first and second electrical signals, second fuel supply amount, the calculation being performed by multiplying a two-dimensional function of the detected intake manifold pneumatic pressure and of the detected engine running speed by a second weighting factor which is smaller than the first weighting factor; calculating a third fuel supply amount by totalling the calculated first fuel supply amount and the calculated second fuel supply amount; and adjusting, depending upon the calculated third fuel supply amount, the actual fuel supply to the engine.

The above object is also achieved by a fuel supply apparatus comprising: means for detecting the intake manifold pneumatic pressure to produce a first electrical signal; means for detecting the engine running speed to produce a second electrical signal; processing means for (1) calculating, in response to the first electrical signal, a first fuel supply amount, the calculation being performed by multiplying a one-dimensional function of the detected intake manifold pneumatic pressure by a first weighting factor, (2) calculating, in response to the first and second electrical signals, a second fuel supply amount, the calculation being performed by multiplying a two-dimensional function of the detected intake manifold pneumatic pressure and of the detected engine running speed by a second weighting factor which is smaller than the first weighting factor, and (3) calculating a third fuel supply amount by totalling the calculated first fuel supply amount and the calculated second fuel supply amount; and means for adjusting, depending upon the calculated third fuel supply amount, the actual fuel supply to the engine.

The above and other related objects and features of the present invention will be apparent from the description of the present invention set forth below, with reference to the accompanying drawings, as well as from the appended claims.

DESCRIPTION OF THE PREFERRED EMBODIMENTS

Figure 1:
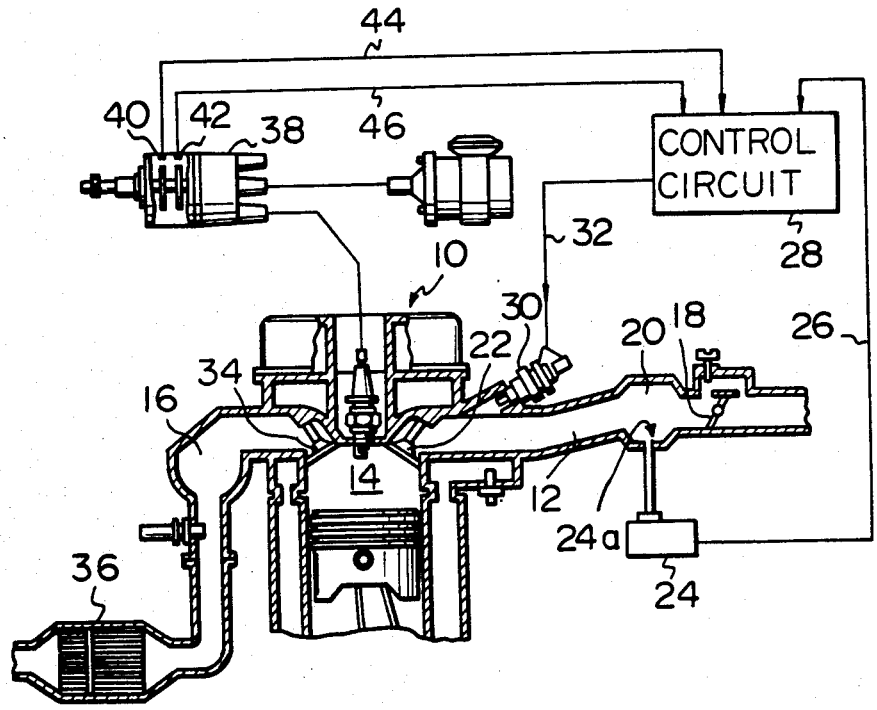
FIG. 1 is a schematic diagram of an electronic fuel injection control system of an internal combustion engine according to the present invention.

In FIG. 1, reference numeral 10 denotes an engine body, 12 an air intake passage, 14 a combustion chamber, and 16 an exhaust passage. The flow rate of outer air introduced into the engine through an air cleaner (not shown) is controlled by a throttle valve 18 interlocked with an accelerator pedal (not shown). The air passing through the throttle valve 18 is introduced into the combustion chamber 14 via a surge tank 20 and an intake valve 22.

In the intake passage 12, at a position downstream of the throttle valve 18, for example, at a position of the surge tank 20, a pressure take-out port **24*a* is opened. The pressure take-out port 24*a* is communicated with a pneumatic pressure sensor 24 which detects the absolute pneumatic pressure in the intake manifold and produces a voltage corresponding to the detected pressure. The output voltage from the pneumatic pressure sensor 24 is fed to a control circuit 28 via a line 26**.

Each of fuel injectors 30 for the cylinders is opened and closed in response to electrical drive pulses fed from the control circuit 28 via a line 32. The fuel injectors 30 intermittently inject into the intake passage 12 compressed fuel from a fuel supply system (not shown) in the vicinity of the intake valve 22.

The exhaust gas produced due to combustion in the combustion chamber 14 is emitted into the atmosphere via an exhaust valve 34, the exhaust passage 16, and catalytic converter 36.

Crank angle sensors 40 and 42 disposed in a distributor 38 produce pulse signals at every crank angle of 30° and 360°, respectively. The pulse signals produced at every 30° crank angle are fed to the control circuit 28 via a line 44. The pulse signals produced at every 360° crank angle are fed to the control circuit 28 via a line 46.

Figure 2:
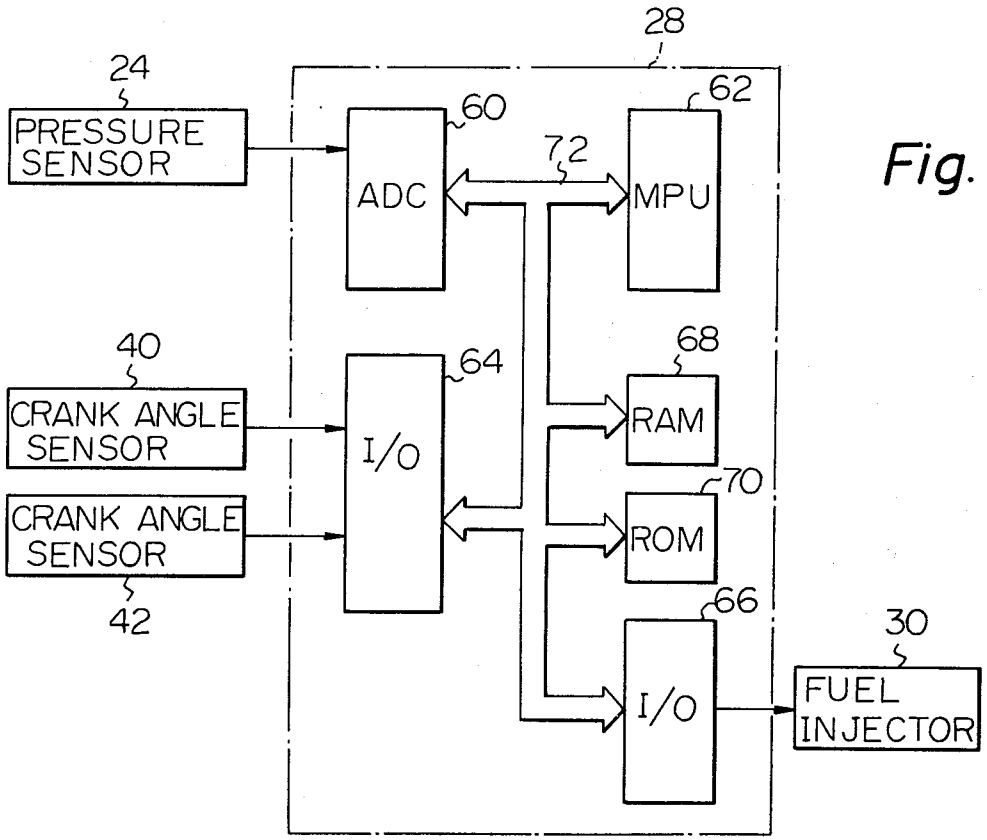
FIG. 2 is a block diagram of a control circuit shown in FIG. 1.

FIG. 2 illustrates an example of the control circuit 28 of FIG. 1. In FIG. 2, the pneumatic pressure sensor 24, crank angle sensors 40 and 42, and fuel injectors 30 are represented by blocks.

The output voltage from the pneumatic pressure sensor 24 and from other sensors (not shown) are applied to an analog-to-digital (A/D) converter 60 which contains an analog multiplexer and A/D converter and are sequentially converted into binary signals in response to instructions from a microprocessor unit (MPU) 62.

The pulse signals produced by the crank angle sensor 40 every 30° crank angle are fed to the MPU 62 via an input-output (I/O) circuit 64 as interrupt-request signals for the interruption routine of every 30° crank angle. The pulse signals from the crank angle sensor 40 are further supplied to a timing counter disposed in the I/O circuit 64 as counting pulses. The pulse signals produced by the crank angle sensor 42 every 360° crank angle are used as reset pulses of the above timing counter. The timing counter produces fuel-injection initiation pulses which are fed to the MPU 62 as interrupt-request signals for the injection interruption routine.

In an I/O circuit 66, a drive circuit which receives a one bit injection pulse having a pulse width TAU calculated by the MPU 62 and converts the injection pulse into a drive signal is provided. The drive signal from the drive circuit is fed to the fuel injectors 30 to inject into the engine a quantity of fuel corresponding to the pulse width TAU.

The A/D converter 60 and I/O circuits 64 and 66 are connected via a bus 72 to the MPU 62, a random access memory (RAM) 68, and a read only memory (ROM) 70, which constitute the microcomputer. The data are transferred via the bus 72.

In the ROM 70 are stored beforehand a routine program for main processing, an interrupt-processing program executed at every 30° crank angle, another routine program, and various types of data or tables which are necessary for carrying out arithmetic calculations.

Hereinafter, the operation of the microcomputer will be illustrated with reference to the flow diagrams of FIGS. 3 and 4.

Figure 3:
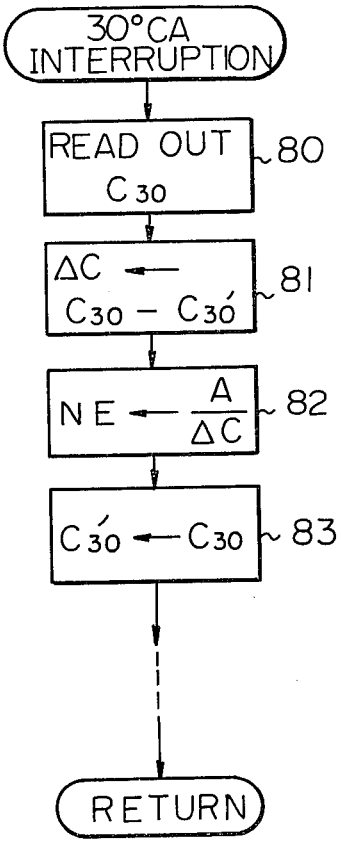
FIGS. 3 and 4 are flow diagrams of parts of the control programs of a microcomputer in the control circuit of FIG. 2.

When a pulse signal at every 30° crank angle is applied from the crank angle sensor 40, the MPU 62 executes the interrupt-processing routine shown in FIG. 3 for producing rpm data which indicates the running speed NE of the engine.

At a point 80, the contents of a free-run counter provided in the MPU 62 are read out and temporarily stored in a register in the MPU 62 as $C_{30}$. At a point 81, the difference C between contents $C_{30}$ of the free-run counter which are read out in the present interruption process and contents $C_{30}'$ of the free-run counter, which contents were read out in the last interruption process, is calculated from $\Delta C = C_{30} - C_{30}'$. Then, at a point 82, the reciprocal of the difference $\Delta C$ is calculated to obtain the running speed NE. Namely, at the point 82, calculation of $NE = A/\Delta C$ is executed, where A is a constant. The calculated NE is stored in the RAM 68. At a point 83, contents $C_{30}$ in the present interruption process are stored in the RAM 68 as contents $C_{30}'$ of the free-run counter in the last interruption process and are used in the next interruption process. Thereafter, another process is executed in the interrupt-processing routine and then the program returns to the main processing routine.

The MPU 62 further introduces binary signals which correspond to the output voltages of the pneumatic pressure sensor 24 and another sensor from the A/D converter 60 in response to the interrupt request which occurs at every completion of A/D conversion. Then, the MPU 62 stores the introduced binary signals in the RAM 68.

Figure 4:
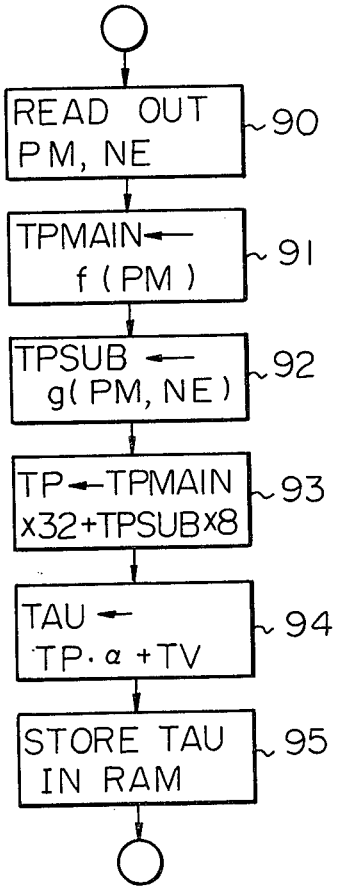

During the main processing routine, the MPU 62 executes the processing, shown in FIG. 4, for calculating the pulse width TAU of the fuel injection signal. First, at a point 90, the MPU 62 reads out the data related to intake manifold pneumatic pressure PM and engine running speed NE from the RAM 68. At a point 91, the MPU 62 finds a pulse width main-value TPMAIN, using the detected intake manifold pressure PM, from a linear function table which indicates a relationship f(PM) between intake manifold pressure PM and pulse width main-value TPMAIN as shown in Table 1. In the ROM 70, a one-dimensional function table having contents corresponding to Table 1 is preliminarily stored. Each item of this linear function table is composed of one byte (8 bits), and the least significant bit (LSB) of this PM-TPMAIN function table expresses a unit of time of 32 μsec. Interpolation is used to find TPMAIN corresponding to PM from the one-dimensional PM-TPMAIN function table.

TABLE 1

| PM | 200 | 300 | 400 | 500 | 600 | 700 | 800 |
|---|---|---|---|---|---|---|---|
| TPMAIN | 25 | 50 | 75 | 100 | 125 | 150 | 175 |

PM (mmHg · abs)

At a pointt 92, the MPU 62 finds a pulse width subvalue TPSUB, using the detected intake manifold pressure PM and the detected engine running speed NE, from a two-dimensional function table which indicates the relationship between the intake manifold pressure PM and engine running speed NE and pulse width subvalue TPSUB as shown in Table 2. In the ROM 70, a two-dimensional function table having contents corresponding to Table 2 is preliminarily stored. Each item of this two-dimensional function table is composed of one byte (8 bits) LSB of this PM,NE-TPSUB function table expresses a unit of time of 8 μsec, smaller than that of the PM-TPMAIN, function table. Interpolation is also used to find TPSUB corresponding to PM and NE from the two-dimensional PM, NE-TPSUB function table.

TABLE 2

| | NE | | | | | | |
|---|---|---|---|---|---|---|---|
| PM | 500 | 1000 | 2000 | 3000 | 4000 | 5000 | 6000 |
| 200 | 10 | 16 | 22 | 26 | 32 | 26 | 20 |
| 300 | 31 | 37 | 40 | 44 | 53 | 47 | 41 |
| 400 | 52 | 58 | 61 | 64 | 70 | 63 | 59 |
| 500 | 69 | 75 | 82 | 86 | 91 | 85 | 79 |
| 600 | 91 | 96 | 101 | 107 | 112 | 105 | 99 |
| 700 | 113 | 116 | 122 | 126 | 129 | 125 | 119 |
| 800 | 133 | 135 | 141 | 147 | 150 | 146 | 138 |

PM (mmHg · abs),
Ne (rpm)

At a point 93, the MPU 62 calculates a basic pulse width TP by multiplying TPMAIN by a first weighting factor of "32" which corresponds to the unit of LSB, multiplying TPSUB by a second weighting factor of "8", which corresponds to the unit of LSB, and then totalling the products. Namely, at the point 93, TP is calculated from the following equation, $$TP = TPMAIN \times 32 + TPSUB \times 8$$

Then, at a point 94, the MPU 62 calculates a final pulse width TAU based upon the basic pulse width TP, a correction coefficient $\alpha$, and the dead injection pulse width TV of the fuel injectors 30, according to the following equation, $$TAU = TP \cdot \alpha + TV$$

The calculated data for the pulse width TAU is stored in a predetermined position of the RAM 68 at a point 95.

There are various methods for producing an injection signal having a duration corresponding to the calculated pulse width TAU. One method is as follows. First, the injection signal is inverted from "0" to "1" and the contents of the free-run counter is read out when a fuel-injection initiation pulse is produced. By using the read out contents, a value corresponding to contents of the free run counter after the time of TAU has elapsed from the development of the fuel-injection initiation pulse is calculated. The calculated values is set to a compare register. When the contents of the free-run counter become equal to the contents in the compare register, an interrupt-request signal is produced to invert the injection signal from "1" to "0". Accordingly, an injection signal having a duration which corresponds to TAU is formed. The above fuel-injection initiation pulse is produced each time the interrupt-processing routine of 30° crank angle shown in FIG. 3.

As aforementioned, two kinds of function table having different unit LSB's are used to calculate the basic pulse width TP from intake manifold pressure PM and from engine running speed NE. The one-dimensional function table of PM-TPMAIN has a greater unit of LSB than that of the two-dimensional function table of PM, NE-TPSUB. In other words TPMAIN is multiplied by the first weighting factor, which is greater than the second weighting factor by which TPSUB is multiplied. Thus, the greater part of value of the basic pulse width TP is determined in accordance with the PM-TPMAIN function table which is higher unit than that of PM, NE-TPSUB function table, and the remaining part of value of the basic pulse width TP is determined in accordance with the PM, NE-TPSUB function table. Therefore, each item of the both function tables can be composed of one byte (8 bits), sharply reducing the number of bits for these tables in the storage device and thus sharply reducing the cost of the storage device, without lowering the accuracy of the calculated basic pulse width. Furthermore, since a one-dimensional function table with respect to intake manifold pressure PM is used to determine the majority of the basic pulse width valve, the number of bits for the table in the storage device can be decreased even more. As the basic pulse width TP depends almost entirely on the intake manifold pressure PM, the majority of the basic pulse width value can be determined only by the one-dimensional function table of PM.

Figure 5:
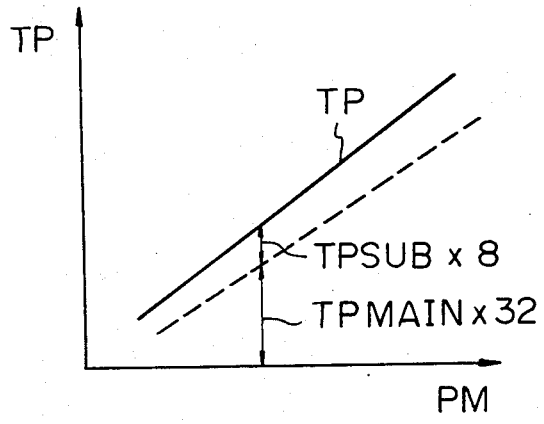
FIG. 5 is a graph of the relation between the intake manifold pneumatic pressure PM and basic pulse width TP.

FIG. 5 indicates characteristics of TP depending upon PM, of TPMAIN×32 and of TPSUB×8, when NE is fixed to 16,00 rpm. As is apparent from FIG. 5, the value of TPMAI×32 accounts for the majority of TP.

In the aforementioned embodiment, TPMAIN is found from a one-dimensional function table. However, according to the present invention, TPMAIN can be found from an algebraic one-dimensional function of TPMAIN=a·PM+b, where a and b are constants.

Many widely different embodiments of the present invention may be constructed without departing from the spirit and scope of the present invention. It should be understood that the present invention is not limited to the specific embodiments described in this specification, except as defined in the appended claims.

We claim:

1. A method of controlling the fuel supply of an internal combustion engine comprising the steps of:

detecting an intake manifold pneumatic pressure to produce a first electrical signal;

detecting an engine running speed to produce a second electrical signal;

calculating, in response to said first electrical signal, a first fuel supply amount, said calculation being performed by multiplying a one-dimensional function of the detected intake manifold pneumatic pressure by a first weighting factor;

calculating, in response to said first and second electrical signals, a second fuel supply amount, said calculation being performed by multiplying a two-dimensional function of the detected intake manifold pneumatic pressure and of the detected engine running speed by a second weighting factor which is smaller than said first weighting factor;

calculating a third fuel supply amount by totalling said calculated first fuel supply amount and said calculated second fuel supply amount; and adjusting, depending upon said calculated third fuel supply amount, the actual fuel supply to the engine.

2. A method as claimed in claim 1, wherein said first fuel supply amount calculating step includes the steps of:

determining a value, using said first electrical signal, from a one-dimensional function representing a relationship between the value and the intake manifold pneumatic pressure; and calculating a first fuel supply amount by multiplying said determined value by a first weighting factor.

3. A method as claimed in claim 2, wherein said one-dimensional function is expressed by a function table.

4. A method as claimed in claim 2, wherein said one-dimensional function is expressed by an algebraic function.

5. A method as claimed in claim 1, wherein said second fuel supply amount calculating step includes the steps of:

determining a value, using said first and second electrical signal, from a two-dimensional function representing a relationship between the value, the intake manifold pneumatic pressure, and the engine running speed; and calculating a second fuel supply amount by multiplying said determined value by a second weighting factor.

6. A method as claimed in claim 5, wherein said two-dimensional function is expressed by a function table.

7. A method as claimed in claim 1, wherein the unit expressed by said one-dimensional function is greater than the unit expressed by said two-dimensional function.

8. An apparatus for controlling the fuel supply of an internal combustion engine comprising:

means for detecting an intake manifold pneumatic pressure to produce a first electrical signal;

means for detecting an engine running speed to produce a second electrical signal;

processing means for (1) calculating, in response to said first electrical signal, a first fuel supply amount, said calculation being performed by multiplying a one-dimensional function of the detected intake manifold pneumatic pressure by a first weighting factor, (2) calculating, in response to said first and second electrical signals, a second fuel supply amount, said calculation being performed by multiplying a two-dimensional function of the detected intake manifold pneumatic pressure and of the detected engine running speed by a second weighting factor which is smaller than said first weighting factor, and (3) calculating a third fuel supply amount by totalling said calculated first fuel supply amount and said calculated second fuel supply amount; and means for adjusting, depending upon said calculated third fuel supply amount, the actual fuel supply to the engine.

9. An apparatus as claimed in claim 8, wherein said processing means includes:

means for determining a value, using said first electrical signal from a one-dimensional function representing a relationship between the value and the intake manifold pneumatic pressure; and means for calculating a first fuel supply amount by multiplying said determined value by a first weighting factor.

10. An apparatus as claimed in claim 9, wherein said one-dimensional function is expressed a function table.

11. An apparatus as claimed in claim 9, wherein said one-dimensional function is expressed by an algebraic function.

12. An apparatus as claimed in claim 8, wherein said processing means includes:

means for determining a value, using said first and second electrical signal, from a two-dimensional function representing a relationship between the value, the intake manifold pneumatic pressure, and the engine running speed; and means for calculating a second fuel supply amount by multiplying said determined value by a second weighting factor.

13. An apparatus as claimed in claim 12, wherein said two-dimensional function is expressed by a function table.

14. An apparatus as claimed in claim 8, wherein the unit expressed by said one-dimensional function is greater than the unit expressed by said two-dimensional function.

* * * * *